US008027501B2

(12) United States Patent
Yang et al.

(10) Patent No.: US 8,027,501 B2
(45) Date of Patent: Sep. 27, 2011

(54) HEADPHONE

(75) Inventors: Chien-cheng Yang, Taichung (TW); Hui-yin Liang, Taichung (TW); Yu-chang Fun, Taichung (TW)

(73) Assignee: Merry Electronics Co., Ltd., Taichung (TW)

( * ) Notice: Subject to any disclaimer, the term of this patent is extended or adjusted under 35 U.S.C. 154(b) by 800 days.

(21) Appl. No.: 12/123,429

(22) Filed: May 19, 2008

(65) Prior Publication Data

US 2009/0285433 A1 Nov. 19, 2009

(51) Int. Cl.
*H01R 25/00* (2006.01)

(52) U.S. Cl. ..... 381/370

(58) Field of Classification Search ..... 381/71.1, 381/71.6, 71.7, 370–374
See application file for complete search history.

(56) References Cited

U.S. PATENT DOCUMENTS

| | | | | | |
|---|---|---|---|---|---|
| 2,423,014 | A * | 6/1947 | Gilman | ..... | 381/150 |
| 4,058,688 | A | 11/1977 | Nishimura et al. | | |
| 4,302,635 | A * | 11/1981 | Jacobsen et al. | ..... | 381/371 |
| 4,922,542 | A * | 5/1990 | Sapiejewski | ..... | 381/373 |
| 5,373,565 | A * | 12/1994 | Watanabe | ..... | 381/182 |
| 5,420,935 | A * | 5/1995 | Shinohara et al. | ..... | 381/370 |
| 6,905,000 | B1 * | 6/2005 | Viveros | ..... | 181/129 |

* cited by examiner

*Primary Examiner* — Tuyen Nguyen
(74) *Attorney, Agent, or Firm* — Chun-Ming Shih

(57) ABSTRACT

A headphone includes a hanger and two speaker units respectively disposed at the two ends of the hanger. Each speaker unit includes a first shell; a second shell engaged with the first shell, a first air passage being formed between the first shell and the second shell, a second air passage being formed on the second shell, the second air passage having an opening direction different from an opening direction of the first air passage; a cover engaged with the second shell and having a plurality of holes on the cover; and a speaker disposed between the first shell and the second shell. When the speaker outputs sound, airflows generated by the speaker are exhausted through the first air passage, the second air passage and the holes so that the amount of air exhaust is stable and the output audio is of high quality.

18 Claims, 5 Drawing Sheets

HEADPHONE

BACKGROUND

1. Field of the Invention

The present invention relates to a headphone, and more particularly, to a headphone that has stable air exhaust and outputs high quality audio.

2. Description of Related Art

Headphones generally have speakers inside. The speakers generate sound waves by vibrating membranes therein. Various structures of headphones have been designed to make the audio coming out of the headphones smoother and of higher quality. For example, it is a common practice to form air holes on headphones.

Referring to FIG. 5, U.S. Pat. No. 4,058,688, discloses a headphone with a speaker unit 90. Multiple holes 92 are formed on a front cover 91 of the speaker unit 90 for a speaker 93 to transmit sound therethrough. In other words, the airflows generated by the speaker 93 flow through the holes 92. To make the sound smoother, multiple holes 95 are formed on a back cover 94 of the speaker unit 90.

However, because the holes 95 are formed on the back cover 94, a desired aesthetic design of the back cover 94 may not be achievable. In addition, to get a smooth and quality sound, the quantity of the holes 95 has to reach a certain number. Otherwise, the air exhaust will be affected and the sound quality will be degraded. With limited area of the back cover 94, it is a challenge to maintain the quality of the sound while controlling the manufacturing cost.

BRIEF SUMMARY

It is, therefore, an object of the present invention to provide a headphone that has stable air exhaust and outputs high quality audio.

To achieve the attainment of these and related objects, an embodiment of the present invention provides a headphone including a hanger and two speaker units respectively disposed at the two ends of the hanger. Each speaker unit includes a first shell; a second shell engaged with the first shell, a first air passage being formed between the first shell and the second shell, a second air passage being formed on the second shell, the second air passage having an opening direction different from an opening direction of the first air passage; a cover engaged with the second shell and having a plurality of holes on the cover; and a speaker disposed between the first shell and the second shell. When the speaker outputs sound, airflows generated by the speaker are exhausted through the first air passage, the second air passage and the holes so that the amount of air exhaust is stable and the output audio is of high quality.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
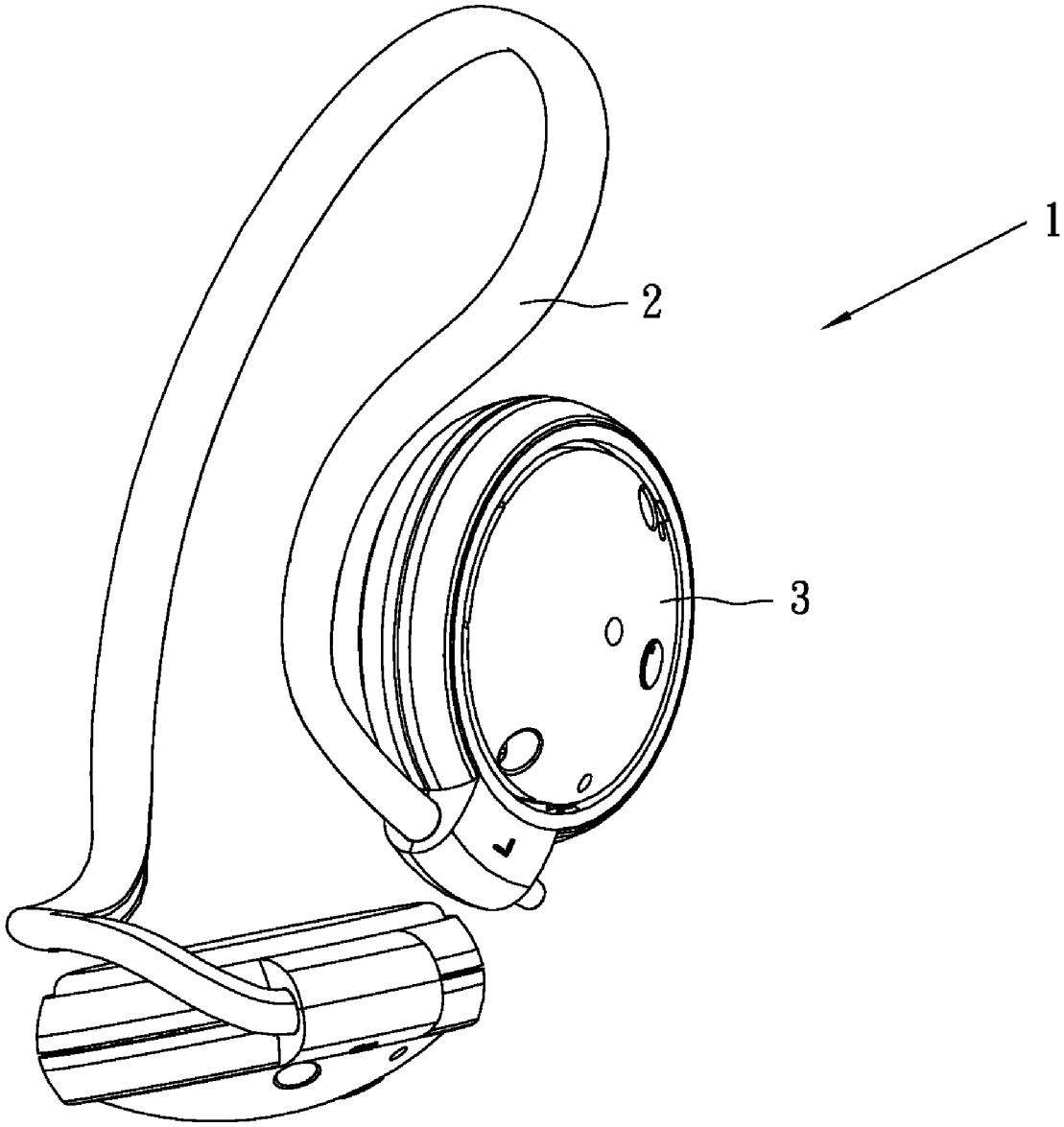
FIG. 1 is a perspective view of a headphone according to an embodiment of the present invention.

Referring to FIG. 1, a headphone 1 according to an embodiment of the present invention is provided. The headphone 1 includes a ring-shaped hanger 2 configured for mounting to a user's head, and two speaker units 3 respectively disposed at the two ends of the hanger 2 for transmitting audio to the user's ears.

Figure 2:
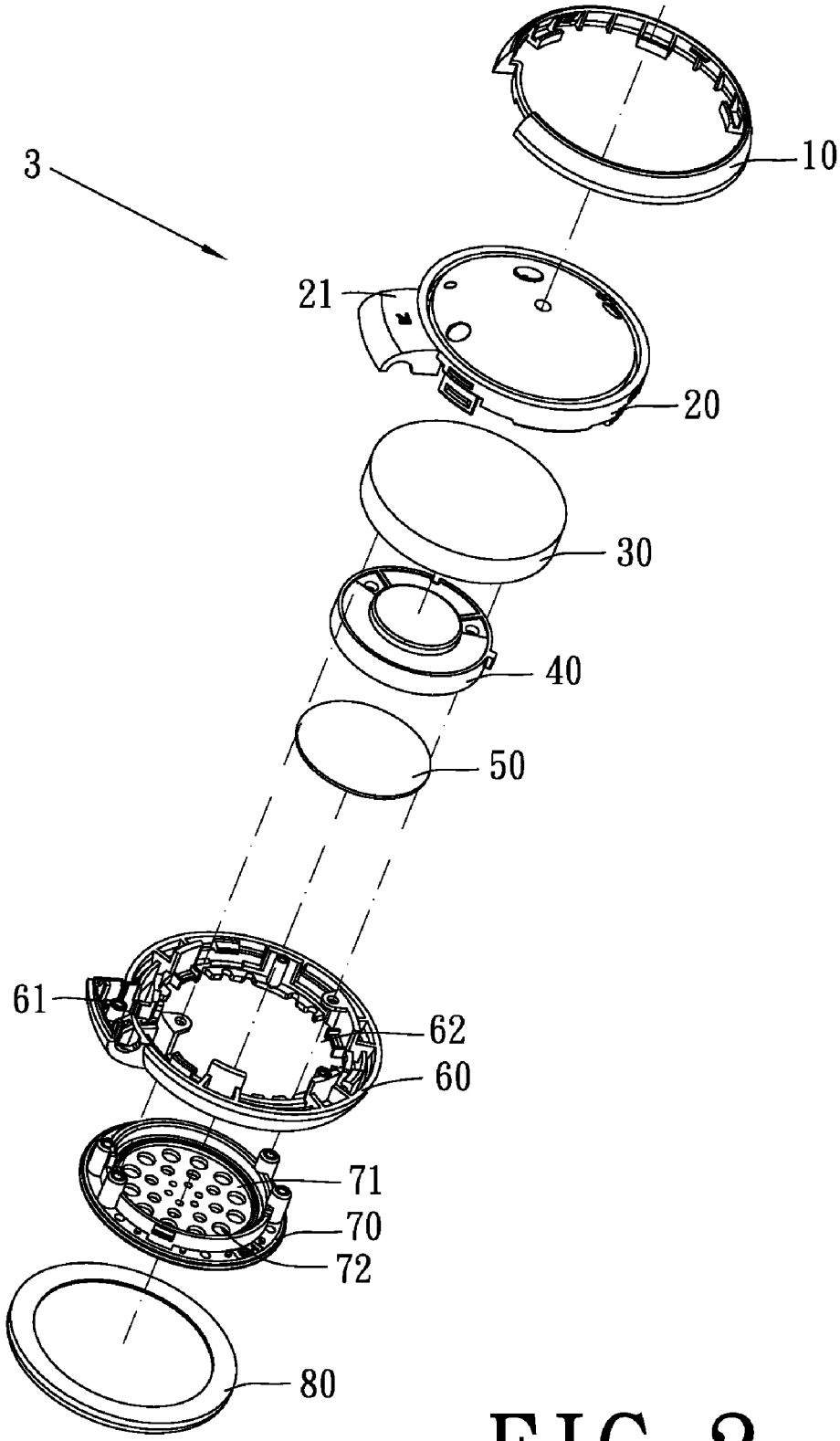
FIG. 2 is an exploded view of a speaker unit of the headphone of FIG. 1.

Referring to FIG. 2, the speaker unit 3 includes a frame body 10, a first shell 20, a sponge 30, a speaker 40, a non-woven fabric 50, a second shell 60, a cover 70 and an earlap 80.

The frame body 10 is disposed covering an outer edge of the first shell 20, and, in this embodiment, one-piece manufactured.

The first shell 20 is configured for being engaged with the second shell 60. The sponge 30, the speaker 40 and the non-woven fabric 50 are sequentially disposed between the first shell 20 and the second shell 60. Two mounting portions 21 and 61 are respectively disposed at an end of the first shell 20 and an end of the second shell 60 and configured for mounting to the hanger 2, as shown in FIG. 1.

The second shell 60 has a through hole 62 in a center thereof. The cover 70 is fixed to the second shell 60 through the through hole 62 by a screw. It is understood that the cover 70 can be fixed to the second shell 60 by other widely used means.

An accommodation 71 is formed in a center of the cover 70 for accommodating the speaker 40 and the non-woven fabric 50. A plurality of through holes 72 are formed on the accommodation 71. The speaker 40 is configured for outputting sound through the non-woven fabric 50 and the through holes 72.

The earlap 80 is made of soft materials so that it can cover an outer edge of the cover 70 and be configured for contacting the user's ears.

Figure 3:
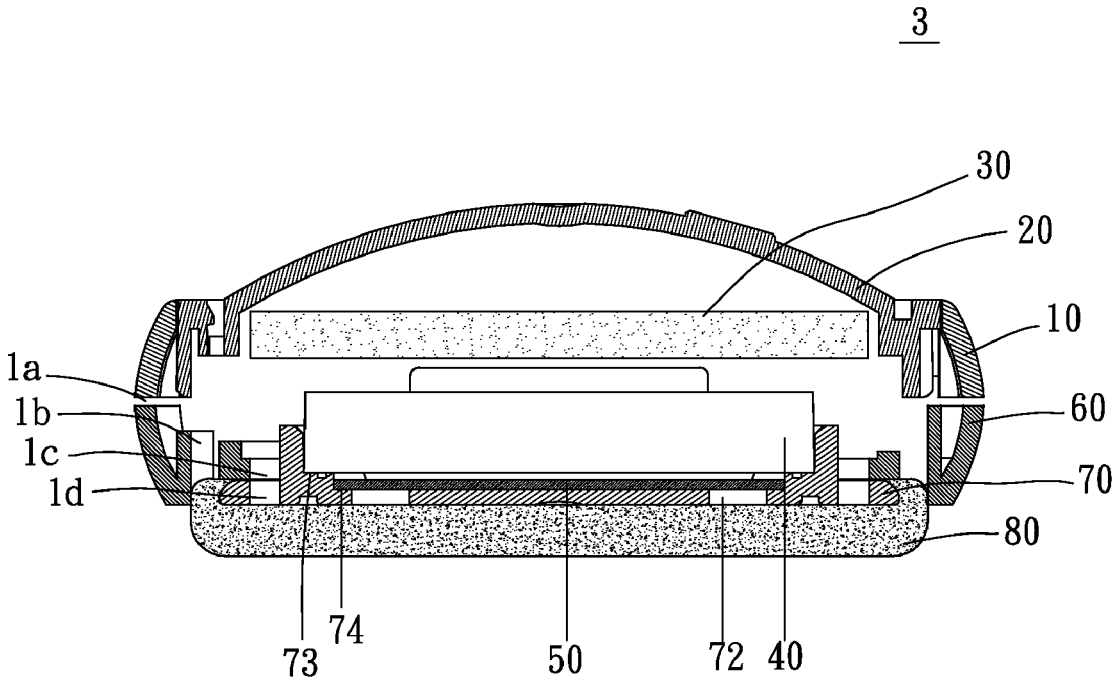
FIG. 3 is a cross-sectional view of the speaker unit of FIG. 2.

Referring to FIG. 3, when the first shell 20 is engaged with the second shell 60, there is space between the first shell 20 and the second shell 60. Such space defines a first air passage 1*a* so that the airflows produced by the speaker 40 when the speaker 40 is outputting sound can be exhausted through the first air passage 1*a*.

Multiple second air passages 1*b* are formed in a ring shape on the bottom of the second shell 60 so that the airflows produced by the speaker 40 when the speaker 40 is outputting sound can be exhausted through the second air passages 1*b*. In this embodiment, the opening direction of the second air passages 1*b* is perpendicular to the opening direction of the first air passage 1*a*. In addition, multiple third air passages 1c are formed in a ring shape on an inner side of the second air passages 1*b* on the second shell 60. In this embodiment, the opening direction of the second air passages 1*b* is parallel with the opening direction of the third air passages 1*c*. Furthermore, multiple fourth air passages 1*d* are formed in a ring shape on an outer side of the through holes 72 on the cover 70 and in connection with the third air passages 1*c* so that the airflows produced by the speaker 40 when the speaker 40 is outputting sound can be exhausted through the fourth air passages 1*d*.

The accommodation 71 of the cover 70 has a first retaining part 73 and a second retaining part 74. The first retaining part 73 has a larger radius than that of the second retaining part 74. The first retaining part 73 is configured for accommodating the speaker 40. The second retaining part 74 is configured for installing the non-woven fabric 50 to keep dirt and dust from entering the accommodation 71.

In this embodiment, the third air passages 1*c*, the second air passages 1*b* and the first air passage 1*a* are sequentially disposed from the inside to the outside of the speaker unit 3.

The earlap 80 is engaged with the cover 70 in a way that a portion of the earlap 80 is protruding from an outer side of the second shell 60 so that the speaker unit 3 can comfortably fit the user's ears. In addition, the earlap 80 is installed between the second air passage 1*b*, the third air passage 1*c*, the fourth air passage 1*d*, the through holes 72 and the outside of the headphone 1 so that the airflows produced by the speaker 40 when the speaker 40 is outputting sound can be exhausted through the earlap 80.

Figure 4:
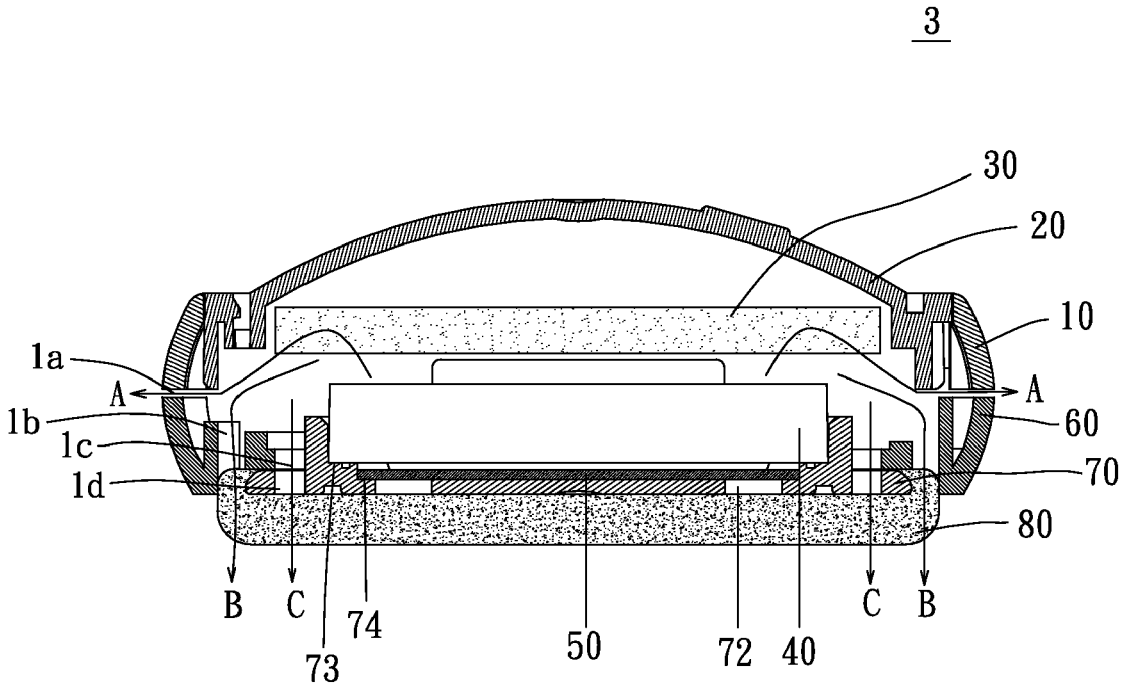
FIG. 4 illustrates the operation of air exhaust of the speaker unit of FIG. 2.
Figure 5:
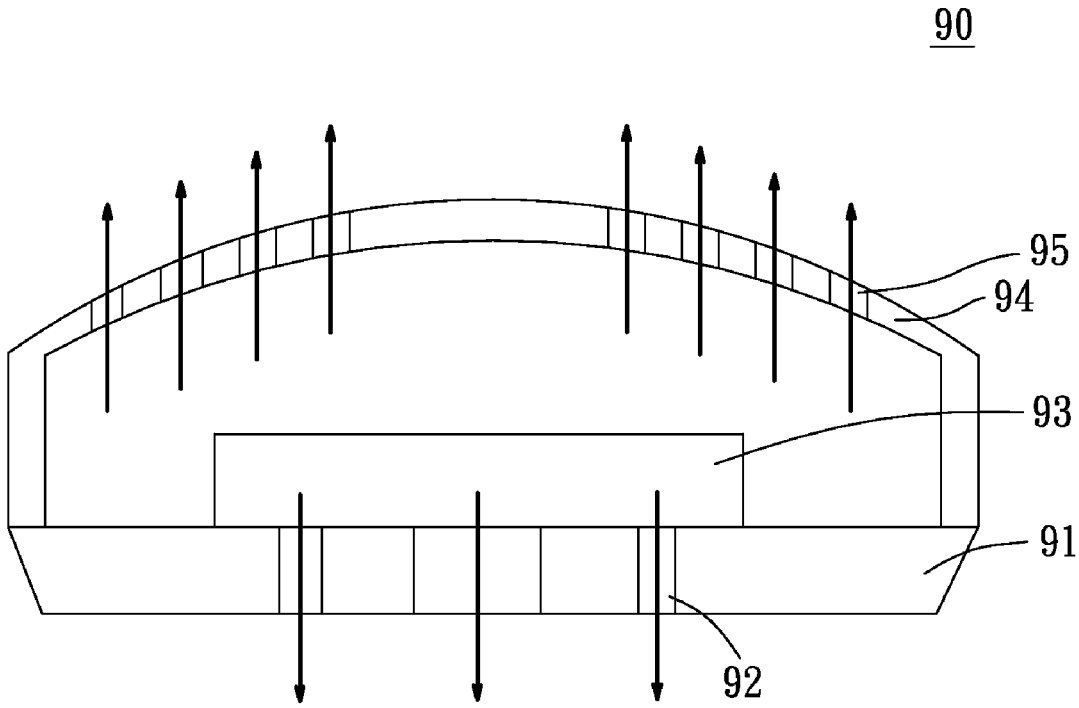
FIG. 5 (prior art)
FIG. 5 is a cross-sectional view of a headphone according to a conventional headphone.

Referring to FIG. 4, when the speaker 40 is outputting sound, airflows are produced by the vibration in the air between the first shell 20 and the second shell 60. A part of the airflows generated by the vibration are transmitted through the non-woven fabric 50 and the through holes 72 to the user's ears. Another part of such airflows go to the sponge 30. Since sponge 30 can filter out noises, when an airflow A over the speaker 40 hits the sponge 30, the noise therein is filtered out. The airflow A is then exhausted from the speaker unit 3 through the first air passage 1*a*. By this means, the sound coming out of the speaker unit 3 is smoothened, the frequency response of the speaker unit 3 is improved and hence the speaker unit 3 is capable of outputting high quality sound.

In this embodiment, to achieve a sufficient amount of air exhaust without making the opening of the first air passage 1*a* excessively large, the second air passage 1*b*, the third air passage 1*c* and the fourth air passage 1*d* are configured to exhaust the airflows B and C as shown in FIG. 4. In addition, the airflow A is greater than the airflows B and C. Such configuration provides an improved frequency response of the speaker unit 3 and the sound generated thereby is smoothened and of high quality.

It is understood that the opening directions of the second air passage 1*b*, the third air passage 1*c* and the fourth air passage 1*d* can be different as what is described above, and can be determined according to the user's needs as long as they are different from the opening direction of the first air passage 1*a*.

In the above embodiment, instead of forming exhaust holes and grooves on the first shell, an air passage is formed between the first shell and the second shell so that the aesthetic design of the headphone is no longer limited. The original texture of the first shell can be kept intact and the manufacturing process is relatively simple. In addition, with the combination of the first, second, third and fourth air passages, the amount of air exhaust is optimized and the frequency response of the speaker unit is improved so that the quality of the output sound is relatively higher.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A headphone having a hanger and two speaker units respectively disposed at two ends of the hanger, each speaker unit comprising:

a first shell;

a second shell engaged with the first shell, a first air passage being formed between the first shell and the second shell, a second air passage being formed on the second shell, the second air passage having an opening direction different from an opening direction of the first air passage;

a cover engaged with the second shell and having a plurality of holes formed thereon; and a speaker disposed between the first shell and the second shell;

wherein when the speaker outputs sound, airflows generated by the speaker are exhausted through the first air passage, the second air passage and the holes.

2. The headphone of claim 1, wherein the first air passage is formed on a side of the second air passage that is further to the center of the speaker unit.

3. The headphone of claim 1, wherein the second air passage is formed in a ring shape on the bottom of the second shell.

4. The headphone of claim 1, further comprising a plurality of third air passages formed in a ring shape on an inner side of the second air passages on the second shell that is closer to the center of the speaker unit.

5. The headphone of claim 1, wherein the first air passage has a ring shape.

6. The headphone of claim 1, wherein the opening direction of the second air passage is perpendicular to the opening direction of the first air passage.

7. The headphone of claim 4, wherein the third air passages are formed between the second shell and the cover.

8. The headphone of claim 4, wherein the opening direction of the second air passage is parallel with the opening direction of the third air passages.

9. The headphone of claim 4, further comprising a plurality of fourth air passages formed in a ring shape on the cover and in connection with the third air passages so that the airflows produced by the speaker are exhausted through the fourth air passages.

10. The headphone of claim 1, wherein the cover further comprises an accommodation formed in a center of the cover for accommodating the speaker.

11. The headphone of claim 10, wherein the accommodation has a first retaining part and a second retaining part, the first retaining part is configured for accommodating the speaker and the second retaining part is configured for installing a non-woven fabric.

12. The headphone of claim 11, wherein the first retaining part has a larger radius than the radius of the second retaining part.

13. The headphone of claim 1, further comprising a sponge disposed between the speaker and the first shell.

14. The headphone of claim 1, further comprising an earlap disposed outside of the cover.

15. The headphone of claim 14, wherein a portion of the earlap protrudes from an outer side of the second shell away from the center of the speaker unit.

16. The headphone of claim 15, wherein the airflows produced by the speaker are exhausted through the second air passage, the holes and the earlap sequentially.

17. The headphone of claim 1, wherein the amount of airflows exhausted through the first air passage is greater than the airflows exhausted through the second air passage.

18. The headphone of claim 1, wherein the holes of the cover have an opening direction perpendicular to the opening direction of the first air passage.

* * * * *